US005642123A

United States Patent [19]

Shinkawa

[11] Patent Number: 5,642,123

[45] Date of Patent: Jun. 24, 1997

[54] APPARATUS FOR ELECTRICALLY DRIVING A RETRACTABLE ANTENNA

[75] Inventor: Masaki Shinkawa, Yamato, Japan

[73] Assignee: Harada Industry Co., Ltd., Tokyo, Japan

[21] Appl. No.: 518,964

[22] Filed: Aug. 24, 1995

[30] Foreign Application Priority Data

Aug. 30, 1994 [JP] Japan ..... 6-205307

[51] Int. Cl.[6] ..... H01Q 1/28

[52] U.S. Cl. ..... 343/903

[58] Field of Search ..... 343/900, 903, 343/901, 715; H01Q 1/28

[56] References Cited

U.S. PATENT DOCUMENTS 2,838,953 6/1958 Cone ..... 343/903

FOREIGN PATENT DOCUMENTS 59-027604 2/1984 Japan .

59-072011 5/1984 Japan .

59-12740 7/1984 Japan .

60-006307 1/1985 Japan .

*Primary Examiner*—Michael C. Wimer

*Attorney, Agent, or Firm*—John P. White

[57] ABSTRACT

An apparatus for electrically driving a retractable antenna comprises a motor, a worm gear attached to the driving shaft of the motor, a pair of worm wheels engaged with the worm gear, a pair of rollers for rotating in accordance with the rotation of the worm wheels to longitudinally transfer a rod antenna element, and a roller urging mechanism for urging the rollers against the outer periphery of the rod antenna element. The roller urging mechanism includes an arm provided in correspondence with at least one of the rollers such that the arm can rotate about its proximal end, and supporting the roller such that the roller can rotate about a distal end of the arm, and a spring for applying an urging force to the arm to urge the roller against the outer periphery of the antenna element.

2 Claims, 4 Drawing Sheets

APPARATUS FOR ELECTRICALLY DRIVING A RETRACTABLE ANTENNA

BACKGROUND OF THE INVENTION

1. Field of the Invention

This invention relates to an apparatus for electrically driving a retractable antenna installed in vehicles such as automobiles, more particularly to an electrically driving apparatus for protruding and retracting (elevating and lowering) a retractable antenna by longitudinally transferring a rod antenna element of the antenna directly by means of a feed roller.

2. Description of the Related Art Japanese Patent Application KOKAI Publication No. 59-27604, for example, discloses an apparatus for electrically driving a retractable antenna. This apparatus comprises a worm wheel engaged with a worm gear coupled with a motor, a first grooved roller arranged coaxial with the worm wheel, and second and third grooved rollers which are arranged at the positions obliquely opposed to the first roller by urging means such as a spring. The first through third roller are urged against the outer periphery of a rod antenna element by the urging means. The first through third roller can be rotated by the rotational force of the motor, so that the rod antenna element is longitudinally transferred. Thus, the antenna is protruded and retracted (elevated and lowered).

This antenna driving apparatus, however, has the defect that the urging force of the urging means such as a spring is hard to be transmitted as an effective transfer force to the outer periphery of the rod antenna element. Therefore, if water, oil, etc. is adhered to the outer periphery of the rod antenna element, a slip may occur between the rollers and the rod antenna element, which makes it difficult, for example, to reliably transfer the rod antenna element.

In the above-described conventional retractable antenna electrically driving apparatus, a slip may easily occur between the rollers and the rod antenna element, and hence the rod antenna element is hard to transfer in a reliable manner. In light of this, the apparatus is not considered so practical.

SUMMARY OF THE INVENTION

The objects of the invention are to provide the following apparatuses for electrically driving a retractable antenna:

(a) An apparatus for electrically driving a retractable antenna, wherein a slip between roller and a rod antenna element is hard to occur and hence the rod antenna element can be reliably transferred;

(b) An apparatus for electrically driving a retractable antenna, equipped with roller urging means capable of easily and accurately bringing the outer peripheral surfaces of the rollers into contact with the outer periphery of the rod antenna element, and capable of urging the rollers against the rod antenna element with a strong force;

(c) An apparatus for electrically driving a retractable antenna, equipped with roller urging means of a simple mechanical structure, and hence being able to easily be manufactured; and (d) An apparatus for electrically driving a retractable antenna, equipped with roller urging means of a compact form.

To attain the above objects, the apparatus for electrically driving a retractable rod antenna element according to the invention has the following structures:

(1) The retractable antenna electrically driving apparatus for protruding/retracting the rod antenna element by longitudinally transferring the same, comprises: a motor having a driving shaft; a worm gear attached to the driving shaft of the motor; a pair of worm wheels engaged with the worm gear; a pair of rollers for rotating in accordance with the rotation of the worm wheels to longitudinally transfer the rod antenna element; and roller urging means for urging the rollers against the outer periphery of the rod antenna element.

(2) The apparatus constructed as above is characterized in that the roller urging means includes an arm provided in correspondence with at least one of the rollers such that the arm can rotate about its proximal end, and supporting the roller such that it can rotate about a distal end of the arm; and a spring for applying an urging force to the arm to urge the roller against the outer periphery of the antenna element.

(3) The apparatus constructed as described in item (1) is characterized in that the roller urging means includes an elastic plate member fixing one end of each of rotary shafts of the rollers and keeping constant the distance between the one ends of the rotary shafts; and a plate spring having an intermediate curved portion with an accumulated force being exerted upon the other end of each of the rotary shafts of the rollers to urge the other ends to approach each other.

(4) The apparatus constructed as described in item (1) is characterized in that the roller urging means includes a pair of rollers each having a structure wherein an annular roller portion is attached to its rotary shaft with an elastic member interposed therebetween, the outer peripheral surfaces of the rollers being opposed to each other, separated by a predetermined distance smaller than the outer diameter of the rod antenna element, the rod antenna element being tightly held between the outer peripheral surfaces of the opposed roller portions.

The above-described structures (1) to (4) provide the following advantages (i) to (iv):

(i) Since in the retractable antenna electrically driving apparatus, the rollers are respectively and individually applied with the rotational forces from a pair of the worm wheels engaged with the worm gear, so as to be rotated. Thus the rotational forces of the rollers are efficiently and reliably transmitted as effective transfer forces to the outer periphery of the rod antenna element. As a result, a slip will hardly occur between the rollers and the rod antenna element, and the antenna element can be transferred in a reliable manner.

(ii) In addition to the advantage described in item (i), in the retractable antenna electrically driving apparatus, the outer surfaces of the rollers can be easily and accurately fitted on the outer periphery of the rod antenna element, and urged against the antenna element with a strong force, since the rollers are urged against the outer periphery of the rod antenna element in accordance with the rotation of the arm.

(iii) In addition to the advantage described in item (i), in the retractable antenna electrically driving apparatus, any particular spring members are not necessary, and accordingly the structures of the roller urging means and the mechanism for transferring the rod antenna element can be simplified, since the rollers are urged against the outer periphery of the rod antenna element by the spring force of the support member itself which supports the rollers.

(iv) In addition to the advantage described in item (i), in the retractable antenna electrically driving apparatus, no space for receiving any elastic member is necessary around the rollers, and therefore the roller urging means can be made compact, since the repulsive forces of the elastic members which is built in the rollers itself urge the roller portions against the outer periphery of the rod antenna element.

BRIEF DESCRIPTION OF THE DRAWINGS

FIGS. 7 to 9 are views, useful in explaining comparative experiments concerning the relationship between the urging force and the antenna element transfer force (driving force) of antenna element transfer rollers incorporated in the above embodiments, wherein:

FIG. 7 is a schematic view, showing a model wherein only one of the rollers is driven and an urging force is applied from the side of the other roller;

FIG. 8 is a schematic view, showing a model wherein both rollers are driven and an urging force is applied from the side of one of the rollers; and FIG. 9 is a graph, showing experimental results obtained where rollers of different materials are used in the FIGS. 7 and 8 models.

DETAILED DESCRIPTION OF THE PREFERRED EMBODIMENTS (First Embodiment)

Figure 1:
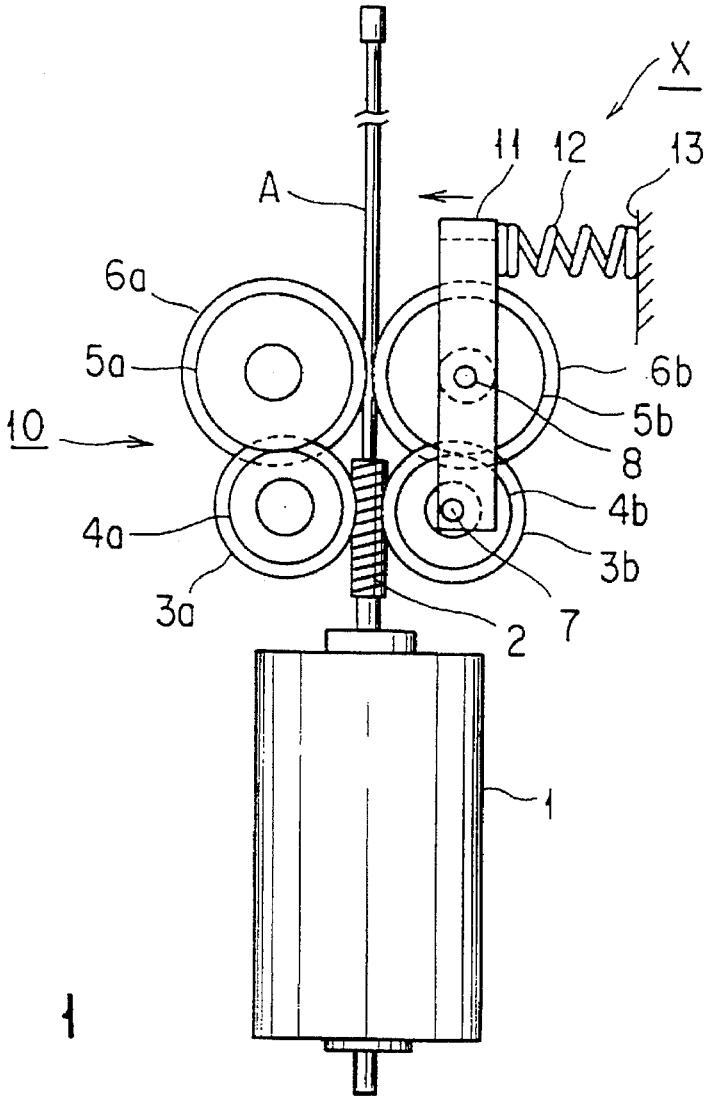
FIG. 1 is a front view, showing an apparatus for electrically driving a retractable antenna according to a first embodiment of the invention.
Figure 2:
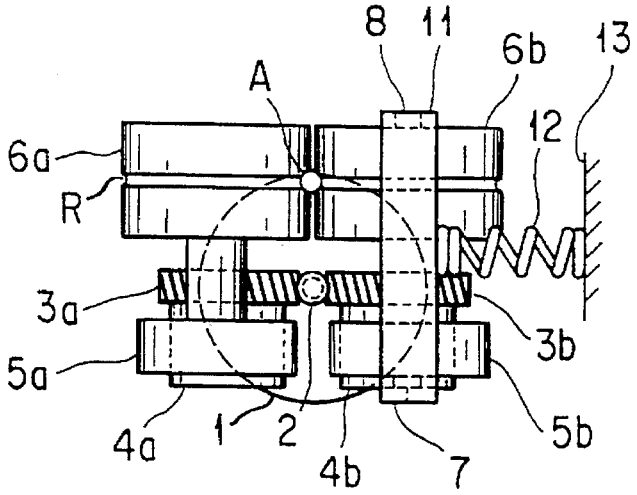
FIG. 2 is a plan view, showing the apparatus for electrically driving a retractable antenna according to the first embodiment of the invention.

FIGS. 1 and 2 are front and plan views, showing an apparatus for electrically driving a retractable antenna according to a first embodiment of the invention. A motor 1 supplies a driving force to longitudinally transfer a rod antenna element A of a small uniform diameter. A worm gear 2 is attached to the rotary shaft of the motor 1. A pair of worm wheels 3*a* and 3*b* opposed to each other are engaged with the outer periphery of the worm gear 2. A pair of first gears 4*a* and 4*b* are provided coaxial and integral with the worm wheels 3*a* and 3*b*, respectively, such that they rotate in synchronism with the rotation of the worm wheels 3*a* and 3*b*. A pair of second gears 5*a* and 5*b* are engaged with the first gears 4*a* and 4*b*, respectively. A pair of grooved rollers 6*a* and 6*b* are provided coaxial and integral with the second gears 5*a* and 5*b*, and rotate in synchronism with the rotation of the second gears. Each of the rollers 6*a* and 6*b* has a groove R formed in an outer peripheral center line portion. The cross section of the groove R has an arcuate shape of a radius of curvature which is slightly smaller than the radius of the rod antenna element A. The above-described elements constitute a main structure of a retractable antenna electrically driving apparatus 10.

The apparatus 10 further has roller urging means X for urging one of the rollers (i.e. roller 6*b*) against the outer periphery of the rod antenna element A.

The roller urging means X comprises a U-shaped arm 11 having a distal end which supports the roller 6*b* such that the roller can rotate, and a proximal end about which the arm can rotate; and a spring 12 which supplies the arm 11 with a rotational force. The proximal end of the U-shaped arm 11 is supported by a common rotary shaft 7 of the worm wheel 3*b* and the first gear 4*b*. The spring 12 is a coiled spring interposed in a compressed state between the distal end of the arm 11 and a fixing base 13. A common shaft 8 which supports the second gear 5*b* and the roller 6*b* is installed to the distal end (in this embodiment, a substantially intermediate portion) of the arm 11.

The transfer operation of the rod antenna element A by means of the apparatus 10 constructed as above will be explained with reference to FIGS. 1 and 2. When the motor 1 has been rotated in a predetermined direction on the basis of an electric signal output from a control unit (not shown), the rotational force of the motor 1 is transmitted to the rod antenna element A via the worm gear 2 installed to the rotary shaft of the motor 1, the worm wheels 3*a*, 3*b*, the first gears 4*a*, 4*b*, the second gears 5*a*, 5*b* and the grooved rollers 6*a*, 6*b*.

At this time, as is indicated by the arrow of FIG. 1, the arm 11 having its proximal end supported by the rotary shaft 7 is urged toward the rod antenna element A with a predetermined force corresponding to the restoring force of the compressed spring 12. Accordingly, the grooved roller 6*b* rotatably supported by the arm 11 is urged against the outer periphery of the rod antenna element A with a sufficiently large urging force. Thus, the outer periphery of the rod antenna element A are tightly held between the grooves R of the grooved rollers 6*a* and 6*b*. Further, the grooved rollers 6*a* and 6*b* are respectively and individually applied with the rotational forces from a pair of the worm wheels 3*a* and 3*b* engaged with the worm gear 2, and accordingly rotate. Thus, the rotational forces of the rollers 6*a* and 6*b* are efficiently and reliably transmitted as effective transfer forces to the outer periphery of the rod antenna element A.

As a result, almost no slip will occur between the grooved rollers 6*a*, 6*b* and the rod antenna element A, and hence the rod antenna element A can be transferred in a stable manner in predetermined directions in accordance with the rotation of the motor 1. Thus, the element A can smoothly be protruded and retracted.

Moreover, since in the first embodiment, the grooved rollers 6*a* and 6*b* are urged against the outer periphery of the rod antenna element A in accordance with the rotation of the rotatable arm 11, the outer peripheral surfaces of the grooved rollers 6*a* and 6*b* are easily and reliably fitted on the outer periphery of the rod antenna element A.

In addition, although in the first embodiment, the spring 12 in a compressed state is interposed between the arm 11 and the fixing base 13, it may give a pull tension force to the arm 11 so as to displace the same toward the antenna element. Although in the first embodiment, the roller urging means X is provided on the side of one of the rollers (i.e. the roller 6*b*), two urging means may be provided for both the rollers 6*a* and 6*b*.

(Second Embodiment)

Figure 3:
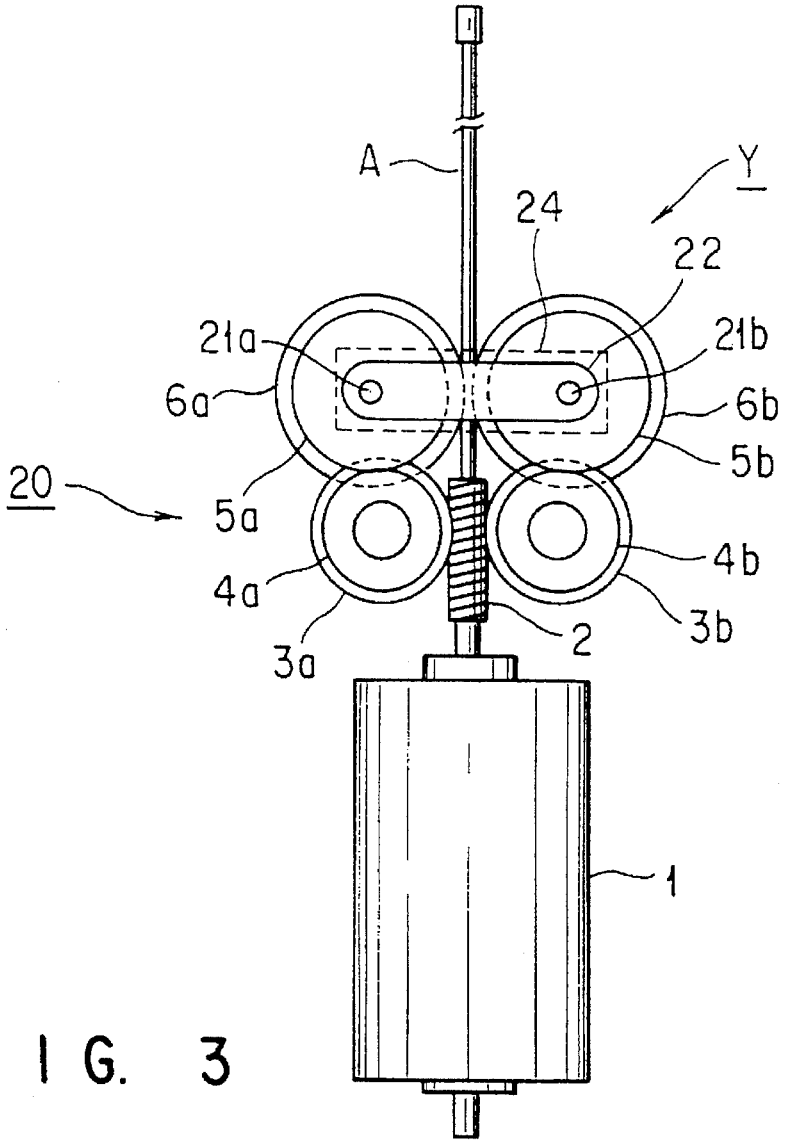
FIG. 3 is a front view, showing an apparatus for electrically driving a retractable antenna according to a second embodiment of the invention.
Figure 4:
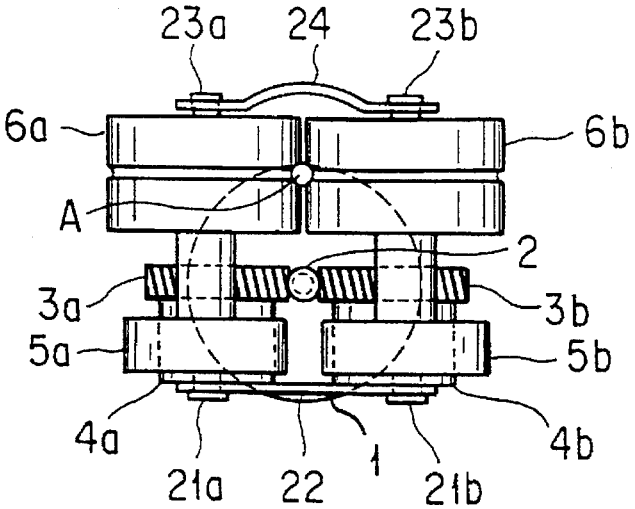
FIG. 4 is a plan view, showing the apparatus for electrically driving a retractable antenna according to the second embodiment of the invention.

FIGS. 3 and 4 are front and plan views, showing an apparatus for electrically driving a retractable antenna according to a second embodiment of the invention. A retractable antenna electrically driving apparatus 20 has a basic structure similar to that of the first embodiment, and further has roller urging means Y constructed as below.

The roller urging means Y comprises an elastic plate member 22 which supports one end 21*a* (21*b*) of each of the rotary shafts of the second gears 5*a* and 5*b* such that the gears are fixed with a predetermined distance therebetween; and a plate spring 24 with an accumulated force resulting from its structure wherein a center portion is curved such that a force is exerted to urge the other ends 23*a* and 23*b* of the rotary shafts of the gears 5*a* and 5*b* to approach each other. A center portion of the elastic plate member 22 is connected to a fixing base (not shown).

The transfer operation of the rod antenna element A by means of the apparatus 20 according to the second embodiment will be explained with reference to FIGS. 3 and 4. As in the first embodiment, when the rotational force of the motor 1 is transmitted to the rod antenna element A via the worm gear 2, the worm wheels 3*a*, 3*b*, the first gears 4*a*, 4*b*, the second gears 5*a*, 5*b* and the grooved rollers 6*a*, 6*b*.

At this time, the ends 21*a* and 21*b* of the respective rotary shafts are supported by means of the elastic plate member 22 such that they can incline to some degree. The other ends 23*a* and 23*b* of the rotary shafts are urged by the force of the plate spring 24 to urge the ends to approach each other (i.e. to urge the ends to approach the antenna element A). Thus, the grooved rollers 6*a* and 6*b* are urged against the outer periphery of the rod antenna element A with a sufficient large force. This being so, the tightness between the grooved rollers 6*a* and 6*b* and the rod antenna element A is high, with the result that no slip will occur therebetween at the time of transferring the rod antenna element A. The optimal value of the urging force of the grooved rollers 6*a*, 6*b* against the rod antenna element A can be obtained by setting the degree of curve, the thickness, the width, etc. of the plate spring 24 to suitable values.

The second embodiment is advantageous in that since the roller urging means Y is mainly constituted by two plate springs, it has a more simple mechanical structure and hence can be manufactured in a more easy manner than the case of using a coiled spring.

(Third Embodiment)

Figure 5:
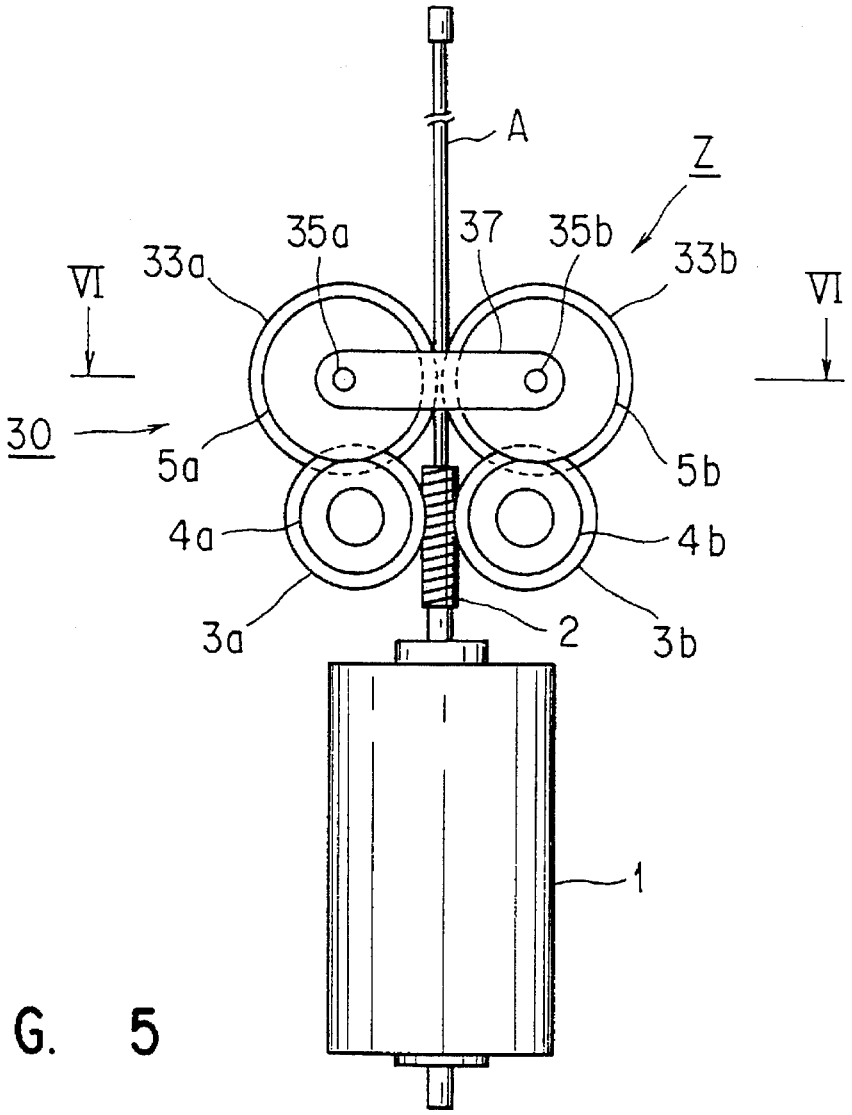
FIG. 5 is a front view, showing an apparatus for electrically driving a retractable antenna according to a third embodiment of the invention.
Figure 6:
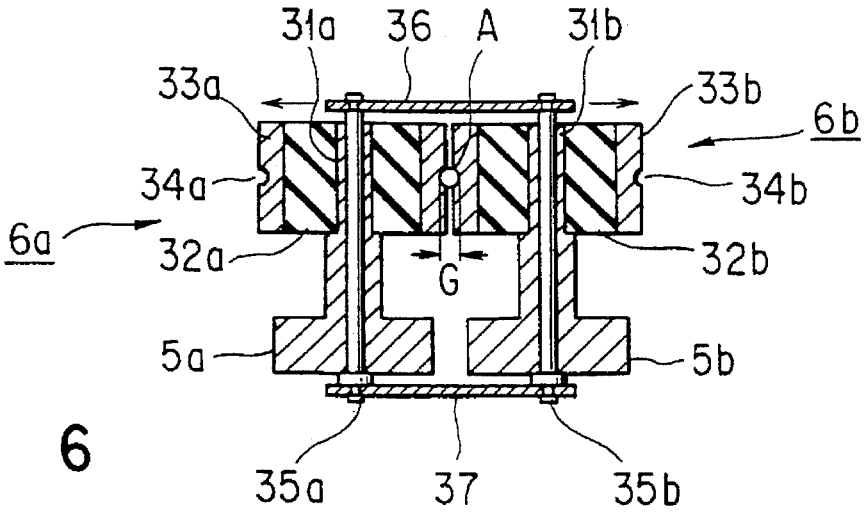
FIG. 6 is a cross sectional view, taken along lines VI to VI of FIG. 5, showing an apparatus for electrically driving a retractable antenna according to the third embodiment of the invention.

FIGS. 5 and 6 are views, showing a retractable antenna electrically driving apparatus 30 according to a third embodiment. Specifically, FIG. 5 is a front view, while FIG. 6 is a cross sectional view, taken along lines IV to IV of FIG. 5. The apparatus 30 has a basic structure similar to that of the first embodiment, and further has roller urging means Z constructed as below.

The roller urging means Z comprises rollers (corresponding to the rollers 6*a* and 6*b*) formed by attaching annular grooved roller portions 33*a* and 33*b* made of a metal hardened material, to the shaft portions 31*a* and 31*b* of the second gears 5*a* and 5*b* with rubber cushions (elastic members) 32*a* and 32*b* interposed therebetween. Grooves 34*a* and 34*b* formed in the roller portions 33*a* and 33*b* are subjected to a notches process to prevent slip. Each of the grooves 34*a* and 34*b* may have a V-shaped cross section, as well as an arcuate cross section. The both opposite ends of the rotary shafts 35*a* and 35*b* of the second gears 5*a* and 5*b* are fixed by means of fixing plates 36 and 37. A gap G between the grooves 34*a* and 34*b* at the opposed faces of the roller portions 33*a* and 33*b* is set narrower than the diameter of the rod antenna element A.

The transfer operation of the rod antenna element A by means of the apparatus 30 according to the third embodiment will be explained with reference to FIGS. 5 and 6. As in the first embodiment, when the rotational force of the motor 1 is transmitted to the rod antenna element A via the worm gear 2, the worm wheels 3*a*, 3*b*, the first gears 4*a*, 4*b*, the second gears 5*a*, 5*b* and the grooved roller portions 33*a*, 33*b*.

Since the gap G between the roller grooves 34*a* and 34*b* is smaller than the outer diameter of the rod antenna element A, when the rod antenna element A is held between the roller grooves 34*a* and 34*b*, the rubber cushions 32*a* and 32*b* are elastically deformed and the roller portions 33*a* and 33*b* are moved in directions indicated by the arrows in FIG. 6. Then, repulsive forces of the rubber cushions are exerted on the rod antenna element A. In other words, strong urging forces are exerted on the antenna element A.

The urging forces of the grooved roller portions 33*a* and 33*b* can be set to optimal values by setting to suitable values the clearance between the rollers, the hardness of the rubber cushion 32*a* (32*b*), etc.

Although in the above-described third embodiment, the grooves 34*a* and 34*b* of the roller portions 33*a* and 33*b* are subjected to a notches process, it depends upon the use conditions whether or not the grooves should be subjected to the notches process.

Moreover, although the first through third embodiments employ a rod antenna element A of a small uniform diameter, a telescope type multi-stage retractable antenna element may be used. More specifically, the distance between rollers employed in the roller urging means X, Y or Z is varied in accordance with the diameter of the antenna element so as to elastically hold the antenna element between the rollers. Further, the more the distance increases, the more the urging force increases. Therefore, the roller urging means are applicable not only to a rod antenna element of a small uniform diameter but also to a multi-stage retractable antenna element.

Figure 7:
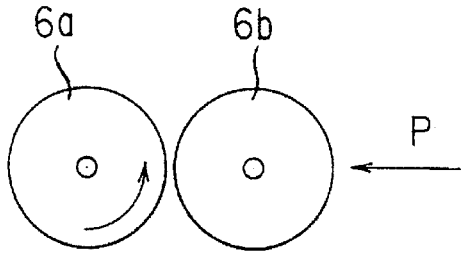
Figure 8:
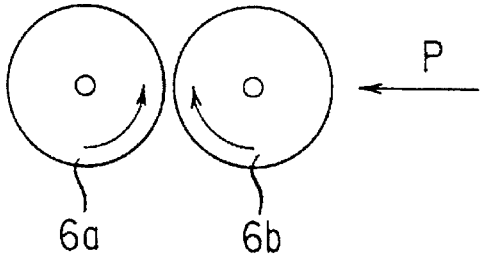
Figure 9:
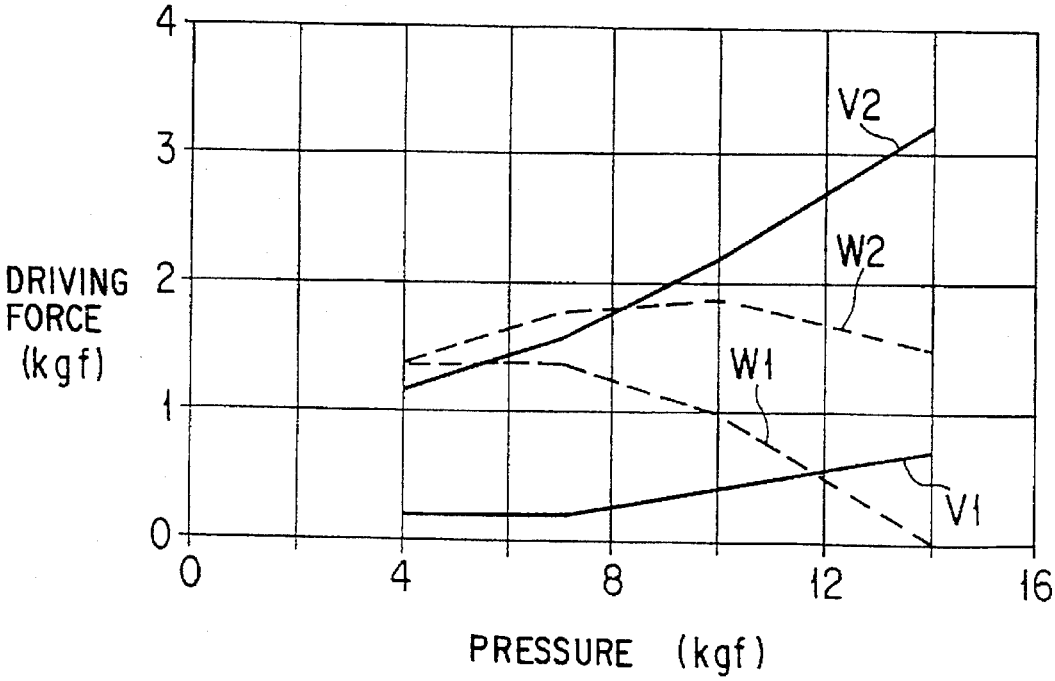

FIGS. 7 to 9 are views, useful in explaining comparative experiments concerning the relationship between the urging force and the antenna element transfer force (driving force) of antenna element transfer rollers incorporated in the roller urging means. The materials of the rollers used in the comparison experiments are rubber and an acetal resin. The acetal resin has a chemical structure expressed by $$-(CH_2-O)_{n1}-X_{n2}-(CH_2-O)_{n3}-X_{n4}-\text{(X: comonomer)}$$

Further, the acetal resin is known as a material which has excellent wear resistance, heat resistance and chemical resistance.

Experiments were performed as regards a FIG. 7 case where only the one roller 6*a* is driven and an urging force P is applied from the side of the other roller 6*b* (this case will be referred to as a "single roller driving system"), and as regards a FIG. 8 case where both the rollers 6*a* and 6*b* are simultaneously driven and the urging force P is applied from the side of the roller 6*b* (this case will be referred to as a "both rollers driving system").

FIG. 9 is a graph, showing experimental results. The V1 solid line indicates characteristics obtained from a case where the acetal resin is used as the roller material and the single roller driving system is employed. The V2 solid line indicates characteristics obtained from a case where the acetal resin is used as the roller material and the both rollers driving system is employed. The W1 broken line indicates characteristics obtained from a case where rubber is used as the roller material and the single roller driving system is employed. The W2 broken line indicates characteristics obtained from a case where rubber is used as the roller material and the both rollers driving system is employed.

As is evident from the experimental results, the transfer force is greater in the case of the both rollers driving system which is employed in the first through third embodiments, than in the case of the single roller driving system. Moreover, the use of acetal resin as the roller material increases the stability of transfer force (driving force) in proportion to an increase in the urging force.

(Summary of the Embodiments)

The structure, operation and advantage of each of the retractable antenna electrically driving apparatuses according to the first through third embodiments will be summarized.

[1] As is explained in the first through third embodiments, an apparatus (10, 20, 30, etc.) for electrically driving a retractable antenna to protrude/retract the rod antenna element A by longitudinally transferring the same, comprises: a motor 1; a worm gear 2 attached to a driving shaft of the motor 1; a pair of worm wheels 3*a* and 3*b* engaged with the worm gear 2; a pair of rollers 6*a* and 6*b* for rotating in accordance with the rotation of the worm wheels 3*a* and 3*b* to longitudinally transfer the rod antenna element A; and roller urging means (X, Y, Z, etc.) for urging the rollers 6*a* and 6*b* against the outer periphery of the rod antenna element A.

According to the apparatus (10, 20, 30, etc.), the rollers 6*a* and 6*b* are respectively and individually applied with the rotational forces from a pair of the worm wheels 3*a* and 3*b* engaged with the worm gear 2, so as to be rotated. Thus the rotational forces of the rollers 6*a* and 6*b* are efficiently and reliably transmitted as effective transfer forces to the outer periphery of the rod antenna element A. As a result, a slip will hardly occur between the rollers 6*a*, 6*b* and the rod antenna element A, and the antenna element can be transferred in a reliable manner.

[2] The apparatus 10 employed in the first embodiment has a structure as described in the above item [1], and is characterized in that the roller urging means X includes an arm 11 provided for at least one of the rollers (i.e. the roller 6*b*) such that the arm 11 can rotate about its proximal end, and supporting the roller 6*b* such that it can rotate about a distal end of the arm 11; and a spring 12 for applying an urging force to the arm to urge the roller 6*b* against the outer periphery of the antenna element A.

According to the apparatus 10, the rollers 6*a* and 6*b* are respectively and individually applied with the rotational forces from a pair of the worm wheels 3*a* and 3*b* engaged with the worm gear 2, so as to be rotated as in the case of the item [1]. Thus, the rotational forces of the rollers 6*a* and 6*b* are reliably and accurately transmitted as effective transfer forces to the outer periphery of the rod antenna element A. Further, since the rollers 6*a* and 6*b* are urged against the outer periphery of the rod antenna element A in accordance with the rotation of the arm 11, the outer surfaces of the rollers 6*a* and 6*b* are easily and accurately fitted on the outer periphery of the rod antenna element A, and urged against the antenna element with a strong force.

[3]. The apparatus 20 employed in the second embodiment has a structure as described in the above item [1], and is characterized in that the roller urging means Y includes an elastic plate member 22 fixing one end 21*a* (21*b*) of each of rotary shafts of the rollers 6*a* and 6*b* and keeping constant the distance between the one ends of the rotary shafts; and a plate spring 24 having an intermediate curved portion with an accumulated force exerted upon the other end 23*a* (23*b*) of each of the rotary shafts of the rollers 6*a* and 6*b* to urge the other ends 23*a* and 23*b* to approach each other.

According to the apparatus 20, the rollers 6*a* and 6*b* are respectively and individually applied with the rotational forces from a pair of the worm wheels 3*a* and 3*b* engaged with the worm gear 2, so as to be rotated as in the case of the item [1]. Thus, the rotational forces of the rollers 6*a* and 6*b* are reliably and accurately transmitted as effective transfer forces to the outer periphery of the rod antenna element A. Since in particular, the rollers 6*a* and 6*b* are urged against the outer periphery of the rod antenna element A by the spring force of the support member itself which supports the rollers, any particular spring members are not necessary, and accordingly the structures of the roller urging means Y and the mechanism for transferring the rod antenna element A can be simplified.

[4]. The apparatus 30 employed in the third embodiment has a structure as described in the above item [1], and is characterized in that the roller urging means Z includes a pair of rollers 6*a* and 6*b* each having a structure wherein an annular roller portion 33*a* (33*b*) is attached to its rotary shaft with an elastic member 32*a* (32*b*) interposed therebetween, the outer peripheral surfaces of the rollers 6*a* and 6*b* being opposed to each other, separated by a predetermined distance smaller than the outer diameter of the rod antenna element, the rod antenna element A being tightly held between the outer peripheral surfaces of the opposed roller portions 33*a* and 33*b*.

According to the apparatus 30, the rollers 6*a* and 6*b* are respectively and individually applied with the rotational forces from a pair of the worm wheels 3*a* and 3*b* engaged with the worm gear 2, so as to be rotated as in the case of the item [1]. Thus, the rotational forces of the rollers 6*a* and 6*b* are reliably and accurately transmitted as effective transfer forces to the outer periphery of the rod antenna element A. Since in particular, the repulsive forces of the elastic members 32*a* and 32*b* which is built in the rollers 6*a* and 6*b* itself urge the roller portions 33*a* and 33*b* against the outer periphery of the rod antenna element A, no space for receiving any elastic member is necessary around the rollers 6*a* and 6*b*, and therefore the roller urging means Z and the antenna element transfer mechanism can be made compact.

[5] In the apparatuses 10 and 20 according to the first and second embodiments, at least that portion of each of the rollers 6*a* and 6*b* which contacts the rod antenna element A is formed of an acetal resin.

The use of the acetal resin as the material of the rollers 6*a* and 6*b* reliably enables the force for transferring the rod antenna element A to increase in proportion to the urging force of the roller urging means (X, Y), thereby more effectively preventing a slip between the rollers 6*a*, 6*b* and the rod antenna element A.

What is claimed is:

1. An apparatus for electrically driving a retractable antenna to retract/protrude a rod antenna element by longitudinally transferring the rod antenna element, comprising:

a motor having a driving shaft;

a worm gear attached to the driving shaft of the motor;

a pair of worm wheels engaged with the worm gear;

a pair of rollers for rotating in accordance with the rotation of the worm wheels to longitudinally transfer the rod antenna element; and roller urging means for urging the rollers against the outer periphery of the rod antenna element, wherein the roller urging means includes:

an elastic plate member fixing one end of each of rotary shafts of the rollers and keeping constant the distance between the one end of each of the rotary shafts; and a plate spring having an intermediate curved portion with an accumulated force being exerted upon the other end of each of the rotary shafts of the rollers to urge the other ends to approach each other.

2. An apparatus for electrically driving a retractable antenna to retract/protrude a rod antenna element by longitudinally transferring the rod antenna element, comprising:

a motor having a driving shaft;

a worm gear attached to the driving shaft of the motor;

a pair of worm wheels engaged with the worm gear;

a pair of rollers for rotating in accordance with the rotation of the worm wheels to longitudinally transfer the rod antenna element; and roller urging means for urging the rollers against the outer periphery of the rod antenna element, wherein the roller urging means includes:

the pair of rollers each having a structure wherein an annular roller portion is attached to the rollers' rotary shaft with an elastic member interposed therebetween, the outer peripheral surfaces of the rollers being opposed to each other, separated by a predetermined distance smaller than the outer diameter of the rod antenna element, the rod antenna element being tightly held between the outer peripheral surfaces of the opposed roller portions.

* * * * *